US008789238B2

(12) United States Patent
Myers

(10) Patent No.: US 8,789,238 B2
(45) **Date of Patent: *Jul. 29, 2014**

(54) ROTATABLE COUPLING FOR STEERING VACUUM CLEANER

(75) Inventor: Steven Wayne Myers, Buffalo Valley, TN (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 13/335,202

(22) Filed: Dec. 22, 2011

(65) Prior Publication Data

US 2012/0090714 A1 Apr. 19, 2012

Related U.S. Application Data

(63) Continuation of application No. 12/615,972, filed on Nov. 10, 2009, now Pat. No. 8,082,624.

(51) Int. Cl.
*A47L 9/00* (2006.01)
*A47L 5/28* (2006.01)

(52) U.S. Cl.
CPC .. *A47L 9/009* (2013.01); *A47L 5/28* (2013.01)
USPC ..... 15/411; 15/351

(58) Field of Classification Search
USPC ..... 15/410, 411, 323, 350, 351, 361, 369, 15/377, 415.1; 285/61, 94, 330, 339
See application file for complete search history.

(56) References Cited

U.S. PATENT DOCUMENTS

| | | | | |
|---|---|---|---|---|
| 1,139,736 | A | | 5/1915 | Stabel |
| 1,318,881 | A | | 10/1919 | Kelley |
| 2,038,697 | A | | 4/1936 | Winslow |
| 2,162,313 | A | | 6/1939 | McCabe et al. |
| 2,170,963 | A | | 8/1939 | Gosta |
| 2,213,792 | A | | 9/1940 | Dow et al. |
| 2,530,886 | A | | 11/1950 | Maisel |
| 2,950,772 | A | | 8/1960 | Dostal et al. |
| 3,189,933 | A | | 6/1965 | Smith |
| 3,451,495 | A | | 6/1969 | Bayless et al. |
| 3,854,164 | A | | 12/1974 | Schmitz |
| 4,050,722 | A | * | 9/1977 | Berger et al. ..... 285/148.19 |
| 4,186,946 | A | * | 2/1980 | Snow ..... 285/94 |
| 4,229,024 | A | * | 10/1980 | Oberrecht et al. ..... 285/98 |
| 4,720,890 | A | | 1/1988 | Jacob |
| 5,078,761 | A | | 1/1992 | Dyson |

(Continued)

FOREIGN PATENT DOCUMENTS

| | | |
|---|---|---|
| DE | 000029907469 U1 | 9/1999 |
| GB | 2391459 | 2/2004 |

(Continued)

*Primary Examiner* — Dung Van Nguyen
(74) *Attorney, Agent, or Firm* — Michael Best & Friedrich LLP

(57) ABSTRACT

A rotatable coupling for a vacuum cleaner is described. The rotatable coupling includes: an inner conduit having an outer surface; a compressible strip disposed on the outer surface of the inner conduit; an outer conduit adapted to snugly fit over the strip and the first conduit. The rotatable coupling can include a non-reactive high-viscosity lubricant disposed on the outer surface of the inner conduit adjacent the strip. The outer conduit of the coupling can be rotatable about the inner conduit and an interference fit is formed between the inner conduit and the outer conduit.

23 Claims, 4 Drawing Sheets

(56) References Cited

U.S. PATENT DOCUMENTS

| | | | | |
|---|---|---|---|---|
| 5,323,510 | A | 6/1994 | Redding et al. | |
| 5,395,141 | A * | 3/1995 | Kakuske | 285/281 |
| 5,409,324 | A * | 4/1995 | Johnson, Jr. | 403/355 |
| 5,584,095 | A | 12/1996 | Redding et al. | |
| 5,794,305 | A | 8/1998 | Weger | |
| 5,839,156 | A | 11/1998 | Park et al. | |
| 6,055,703 | A | 5/2000 | Redding et al. | |
| 6,334,234 | B1 | 1/2002 | Conrad | |
| 6,345,408 | B1 | 2/2002 | Nagai | |
| 6,442,793 | B1 | 9/2002 | Paterson | |
| 6,494,544 | B1 | 12/2002 | Berfield et al. | |
| 6,519,807 | B1 | 2/2003 | Thomson | |
| 6,519,810 | B2 | 2/2003 | Kim | |
| 6,561,591 | B2 | 5/2003 | Zimet | |
| 6,572,078 | B1 | 6/2003 | Thomson et al. | |
| 6,974,488 | B2 | 12/2005 | Dyson | |
| 6,991,666 | B2 | 1/2006 | Organ | |
| 7,000,285 | B2 | 2/2006 | Conner et al. | |
| 7,290,309 | B2 | 11/2007 | Rocke | |
| D567,459 | S | 4/2008 | Dyson et al. | |
| D570,561 | S | 6/2008 | Dyson et al. | |
| 7,805,804 | B2 | 10/2010 | Loebig | |
| 8,047,579 | B2 * | 11/2011 | Taillon | 285/280 |
| 8,082,624 | B2 * | 12/2011 | Myers | 15/411 |
| 2002/0178532 | A1 | 12/2002 | Amoretti | |
| 2006/0080803 | A1 | 4/2006 | Stein | |
| 2006/0207054 | A1 | 9/2006 | Loebig | |
| 2007/0017061 | A1 | 1/2007 | Yan | |
| 2009/0056059 | A1 | 3/2009 | Mersmann | |

FOREIGN PATENT DOCUMENTS

| | | | |
|---|---|---|---|
| GB | 2441299 | | 3/2008 |
| GB | 2456195 | | 7/2009 |
| JP | 8084694 | A | 4/1996 |
| JP | 2001000368 | | 1/2001 |
| JP | 2001204667 | A | 7/2001 |
| SU | 1567185 | A1 | 5/1990 |
| WO | 03055370 | A1 | 7/2003 |

* cited by examiner

ROTATABLE COUPLING FOR STEERING VACUUM CLEANER

CROSS REFERENCE

This application is a continuation of U.S. patent application Ser. No. 12/615,972, filed Nov. 10, 2009 which will issue as U.S. Pat. No. 8,082,624 on Dec. 27, 2011.

TECHNICAL FIELD

The present teachings are directed toward the improved maneuverability of upright vacuum cleaners. In particular, the disclosure relates to a rotatable coupling for an upright vacuum cleaner that allows steering of a vacuum base by rotating the coupling.

BACKGROUND

A need has been recognized in the vacuum cleaner industry for upright model vacuum cleaners that are easily maneuverable around objects which typically occupy the areas being cleaned. The prior art is replete with upright vacuum cleaners having L-shaped nozzles which assist an operator in cleaning around objects such as chair legs. The prior art does not, however, exemplify upright vacuum cleaners with easy to operate steering mechanisms which facilitate the operator's ability to maneuver the vacuum around any objects. Often, prior art steering systems leak and are undesirably heavy. Prior art steering systems can sometimes be cost-prohibitive. Also, lubricants in prior art steering systems generally need to be replaced or they may stop working effectively, such as when the lubricants are exposed to dirty airflows. In prior art steering systems, dirt may get in the couplings used to provide the steering and may wear the joint out.

SUMMARY

According to one embodiment, a steerable vacuum cleaner is described. The vacuum comprises: a base; a handle having a longitudinal axis and including a conduit; and a rotatable coupling pivotally attached between the base and the handle, with the coupling defining an air channel for providing a flow of air from the base to the conduit in the handle. The base of the vacuum rotates about the longitudinal axis while pushing the vacuum by twisting the handle.

In some embodiments, the rotatable coupling comprises: a compressible strip disposed on the outer surface of the inner conduit, wherein the strip is disposed on the inner conduit, an outer conduit adapted to snugly fit over the strip and the first conduit, and a non-reactive lubricant disposed on the outer surface of the inner conduit adjacent the strip. In the coupling, the outer conduit is rotatable about the inner conduit and an interference fit is formed between the inner conduit and the outer conduit.

In some embodiments, the handle conveys an airflow generated in the vacuum cleaner base.

In some embodiments, the vacuum comprises a rotatable volute disposed at a distal end of a conduit selected from either the inner or outer conduit, wherein a longitudinal axis of the conduit traverses through a conduit center that does not traverse a center of the volute and a rotation of the volute allows the conduit to pivot about a volute center.

In some embodiments, the handle is pivoted about the base by raising or lowering the handle.

In some embodiments, the handle is locked in an upright position by centering the handle and raising the handle to engage a lock.

In some embodiments, the handle is unlocked from an upright position by placing a foot on the base and lowering the handle to disengage a lock.

According to various embodiments, a method to steer a vacuum cleaner is described. The method comprises: providing a base; providing a vacuum cleaner handle having a longitudinal axis and including a conduit; pivotally attaching a rotatable coupling between the base and the handle, with the coupling defining an air channel for providing a flow of air from the base to the conduit in the handle. The base of the vacuum rotates about the longitudinal axis while pushing the vacuum by twisting the handle.

In some embodiments, the rotatable coupling comprises: a compressible strip disposed on the outer surface of the inner conduit, wherein the strip is disposed on the inner conduit, an outer conduit adapted to snugly fit over the strip and the first conduit, and a non-reactive lubricant disposed on the outer surface of the inner conduit adjacent the strip. In the coupling, the outer conduit is rotatable about the inner conduit and an interference fit is formed between the inner conduit and the outer conduit.

In some embodiments, the handle conveys an airflow generated in the vacuum cleaner base.

In some embodiments, the method further comprises providing a rotatable volute disposed at a distal end of a conduit selected from either the inner or outer conduit, wherein a longitudinal axis of the conduit traversing through a conduit center does not traverse a center of the volute and a rotation of the volute allows the conduit to pivot about a volute center.

In some embodiments, the method further comprises pivoting the handle about the base by raising or lowering the handle.

In some embodiments, the method further comprises locking the handle by centering the handle and raising the handle to engage a lock.

In some embodiments, the method further comprises unlocking the handle by placing a foot on the base and lowering the handle to disengage a lock.

According to various embodiments, a rotatable coupling for conveying an airflow is described. The rotatable coupling comprises: an inner conduit having an outer surface; a compressible strip disposed on the outer surface of the inner conduit, wherein the strip is disposed the outer surface of the inner conduit; an outer conduit adapted to snugly fit over the strip and the first conduit; and a non-reactive high-viscosity lubricant disposed on the outer surface of the inner conduit adjacent the strip. The outer conduit of the coupling is rotatable about the inner conduit and an interference fit is formed between the inner conduit and the outer conduit.

In some embodiments, the non-reactive lubricant and the strip form the interference fit.

In some embodiments, the rotatable coupling further comprises a bearing surface disposed in the outer conduit and a bearing detent complementing the bearing surface disposed in the inner conduit.

In some embodiments, the rotatable coupling further comprises a bearing surface disposed in the inner conduit and a bearing detent complementing the bearing surface disposed in the outer conduit.

In some embodiments, the rotatable coupling further comprises a handle including the coupling wherein the steerable handle is pivotally connected to a vacuum base.

In some embodiments, the inner conduit is pivotally connected to a vacuum base.

In some embodiments, the outer conduit includes a dog-leg turn.

In some embodiments, the rotatable coupling further comprises a volute disposed at a distal end of a conduit selected from either the inner or outer conduit. A longitudinal axis of the conduit can traverse through a conduit center does not traverse a center of the volute. The volute can be rotatable and allow the conduit to pivot about a volute center.

In some embodiments, a vacuum with the rotatable coupling comprises an air moving unit to generate the airflow and the coupling is disposed on the pressure-side of the air moving unit. The airflow can be a dirty airflow. The non-reactive lubricant can be disposed on the strip.

In some embodiments, the strip comprises synthetic felt.

In some embodiments, the rotatable coupling further comprises a clamp to restrain a movement of the inner conduit with the respect to outer conduit along a longitudinal axis of the inner and outer conduits.

In some embodiments, the inner conduit comprises a first longitudinal portion including a groove along the first longitudinal portion's length, and a second longitudinal portion including a tongue along the second longitudinal portion's length. A compression seal can be disposed in the groove along the first longitudinal portion's length. A groove adapted to receive the strip can be disposed in the outer surface of the inner conduit.

In some embodiments, the rotatable coupling further comprises a pair of detents disposed on the outer surface of the inner conduit proximate the end, and the bearing surface comprises a pair of grooves disposed on the inner surface of the outer conduit and the pair of grooves complement the pair of detents. The strip is disposed between the pair of detents.

BRIEF DESCRIPTION OF THE DRAWINGS

The same reference number represents the same element on all drawings. It should be noted that the drawings are not necessarily to scale. The foregoing and other objects, aspects, and advantages are better understood from the following detailed description of a preferred embodiment of the invention with reference to the drawings, in which.

DETAILED DESCRIPTION

Figure 1:
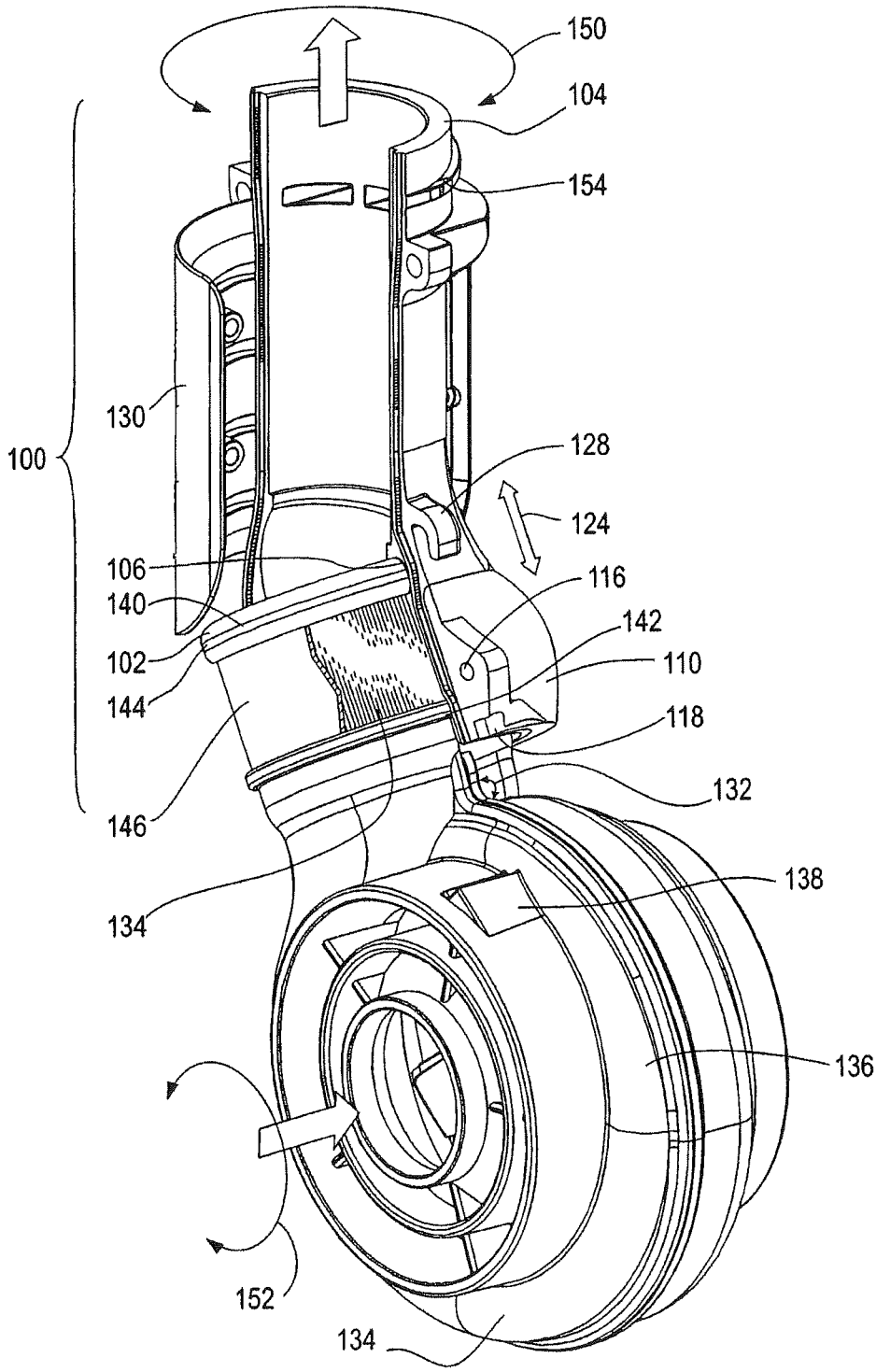
FIG. 1 is a cut away left perspective view of an exemplary embodiment of the steering coupling.

The present teachings provide an upright vacuum cleaner having improved steering features. The essential structure of the vacuum comprises a handle, body, nozzle base and air duct therein. A swivel joint or steering mechanism at the junction of the nozzle base and body comprises a rotatable coupling pivotally connected to the main air duct of the vacuum. The rotatable coupling causes the nozzle base of the vacuum to turn right with a clockwise twist of the vacuum handle and turn left with a counter-clockwise twist of the vacuum handle. The main air duct is in air flow communication with a vacuum motor located in the body of the vacuum spaced from a distal end of the air duct with respect to the flow of air.

In some embodiments, the rotatable coupling of the present teachings can be part of an upright vacuum cleaner in which the vacuum motor is located in the air path that contains dirt from a cleaning surface (sometimes referred to as a "dirty-air" type vacuum). In some embodiments, the mass of the nozzle base can be significantly reduced by employing a low weight motor. In some embodiments, the mass of a dirt bag and its contents can be disposed on a handle of the vacuum cleaner. The result can be an upright vacuum with significantly greater maneuverability. With the weight re-distributed away from the base and more toward the handle, an operator generally need not work as hard to affect the steering features. The nozzle base can be much more responsive to the operator and achieves more of a turning effect and less of a sliding effect during use.

In some embodiments, by placing the steering mechanism mostly outside the nozzle base, a lower profile of base nozzle can be achieved. This has various advantages as well. For example, the vacuum nozzle may more readily fit under objects which are low to the ground, i.e., sofas, ottomans, certain tables, etc.

In some embodiments, by including the volute in the steering mechanism, the weight of the vacuum base can be reduced. By adding more functionality to an existing part of the vacuum, i.e., the volute, the number of parts needed to provide a steering mechanism can be reduced. This can further reduce the weight of the base nozzle or, again, may result in a lower base nozzle profile.

The rotatable coupling of the present teachings is for use with low viscosity fluids such as air. In some embodiments, the coupling described herein is disposed in a dirty air path of a vacuum. A non-reactive, high-viscosity lubricant may be used in conjunction with the rotatable coupling, such as to enhance the air- or dust-tight seal of the rotatable coupling. In some applications, if dirt from the air path contacts the lubricant, it may be trapped by such lubricant. The trapping of the dirt extends the life of the coupling.

In some embodiments, airflows of approximately 70-150 cubic feet per minute (CFM) through a one (1) inch orifice can be communicated through the coupling without causing degradation. In some embodiments, bearing surfaces may be configured to yield even higher CFM capacities. For example, additional bearings and corresponding bearing surfaces can be provided so that the rotatable couplings are able to withstand higher pressures in certain applications.

FIG. 1 is a cut away left perspective view of an exemplary embodiment of steering or rotatable coupling 100. Coupling 100 comprises an inner conduit 102 and an outer conduit 104 disposed around inner conduit 102. FIG. 1 only illustrates only one half of outer conduit 104. Outer conduit 104 can be formed as one piece. In some embodiments, outer conduit 104 can be formed with two or more pieces, for example, outer conduit 300 of FIG. 3.

Inner conduit 102 can comprise a first detent 140. Outer conduit 104 can comprise a bearing surface 106 that complements first detent 140 Inner conduit 102 can comprise a second detent 142. Outer conduit 104 can comprise a second bearing surface (not shown) to complement second detent 142. The complementary surfaces, in some applications, may be configured to enhance either the air- or dust-tight seal, or contribute to the desired interference fit between inner and outer conduits 102, 104 (or both). The diameter of outer conduit can vary along its length. For example, a diameter of outer conduit 104 proximate bearing surface 106 can be smaller than a diameter of outer conduit 104 proximate the second bearing surface.

A non-reactive lubricant 144 can be disposed on first detent 140 and/or on second detent 142. In some embodiments, a non-reactive lubricant can be disposed on bearing surface 106 or on the second bearing surface. A compressible strip 134 can be disposed on inner conduit 102 in a manner to encircle inner conduit 102. Strip 134 can be disposed on an outer surface 146 of inner conduit 102. Outer surface can define a groove to dispose strip 134 therein. In some embodiments, lubricant 144 can moisten compressible strip 134. Inner conduit 102 and outer conduit 104 are configured so as to be rotatable relative to each other along their respective central axes, such as by rotation indicated by arrows 150.

A volute 136 can be disposed at an end of inner conduit 102. Inner conduit 102 can meet volute 136 at an angle 132 tangential to the circumference. That is, the central axis of inner conduit 102 intersects the outer circumference of volute 136 at a point where the tangent forms an angle other than 90°. In some embodiments, this angle can be about 150 degrees. Volute 136 can be rotatable about its central axis, such as by rotation indicated by arrows 152. A volute that is rotatable about its central axis is described in U.S. Pat. No. 6,442,793, which is incorporated herein in its entirety by reference. When a handle 404 (FIG. 4A) is affixed to outer conduit 104, the handle pivots due to the rotational ability of volute 136 per arrow 152. This pivoting arrangement is one way that rotatable coupling 100 may be pivotably attached between base 402 (FIG. 4A) and handle 404. The handle can be affixed using a thread 154 disposed on outer conduit 104. Volute 136 can include a locking ledge 138 to engage a locking tab (not shown) in the vacuum base.

A clamp 110 can be disposed around outer conduit 104. Clamp 110 can include a clamp rotational detent 118. Clamp rotational detent 118 can accept a locking tab (not shown), for example, a male portion disposed on a vacuum base. Clamp 110 can be fastened about the outer conduit by affixing a fastener, for example, a screw (not shown), through a hole 116. Clamp rotational detent 118 can comprise a bridge-shaped void formed in clamp 110 near its bottom to accept locking tab therein. Clamp 110 can keep outer conduit 104 from separating from or moving relative to inner conduit 102, such as along longitudinal axis 124.

A locking ledge 138 can keep the vacuum handle in a locked upright position. In some embodiments, the outer conduit 104 includes a bag hook 128. In some embodiments, a name plate 130 can be disposed about outer conduit 104.

Figure 2:
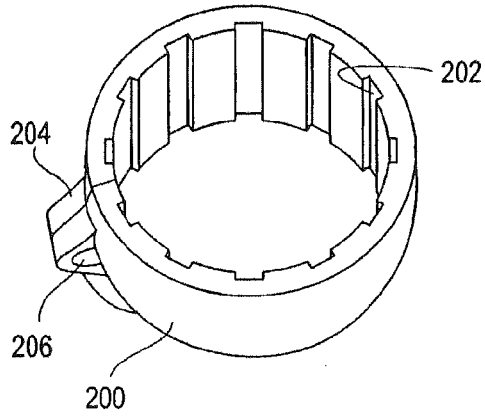
FIG. 2 illustrates one embodiment of a clamp for a coupling.

FIG. 2 illustrates one embodiment of a clamp 200 for use in conjunction with rotatable coupling 100 formed with inner conduit 102 and outer conduit 104, as illustrated in FIG. 1. Clamp 200 can include a clamp rotational detent 204. Clamp rotational detent 204 can accept a locking tab (not shown), for example, a male portion disposed on a vacuum base. Clamp 200 can be fastened about the outer conduit by affixing a fastener, for example, a screw, through a hole 206. Clamp 200 can include grooves 202 in its inner surface. Clamp grooves 202 can remove portions of the material forming clamp 200. Grooves 202 can render clamp 200 flexible without negatively impacting its strength.

Figure 3:
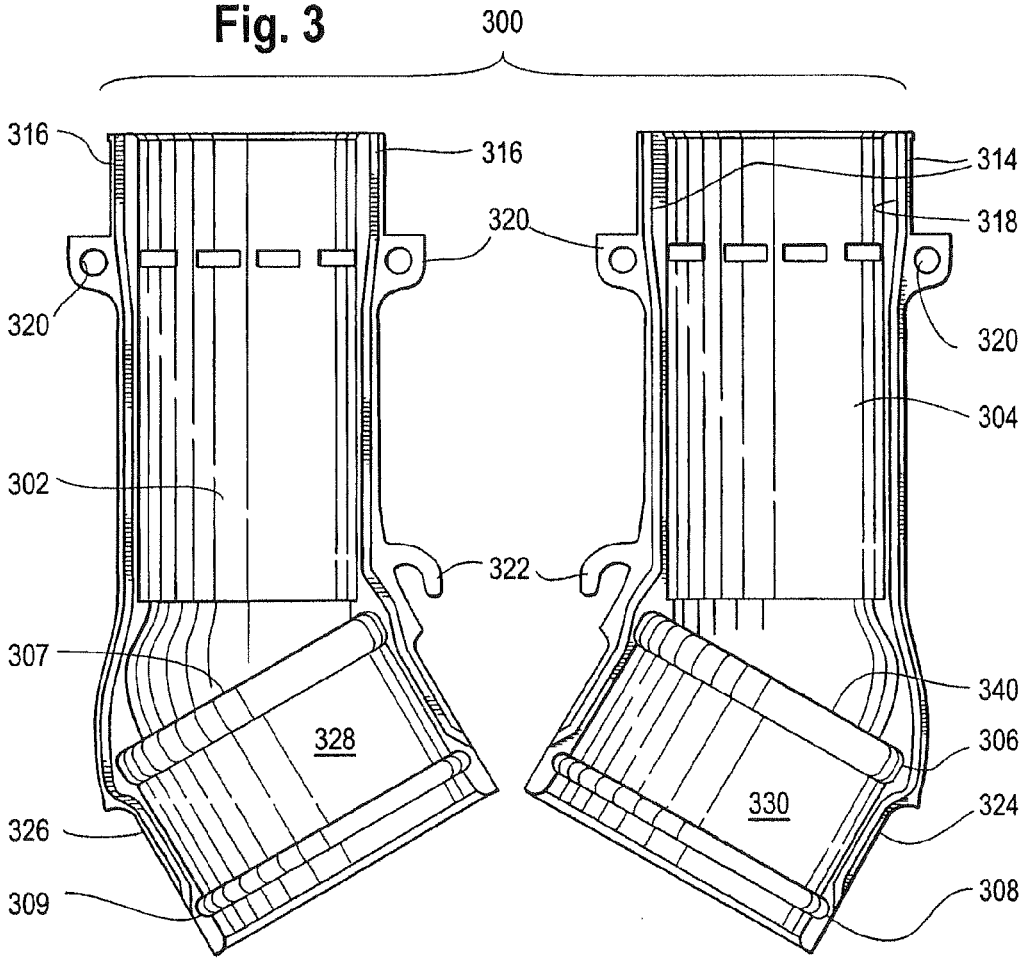
FIG. 3 illustrates one embodiment of an outer conduit.

FIG. 3 illustrates one embodiment of the two mating halves that comprise an outer conduit 300. In some embodiments, outer conduit 300 can be used as outer conduit 104 of FIG. 1. Outer conduit 300 can be formed using halves 302 and 304. A first groove or bearing surface 307 can be disposed in first half 302. A first groove or bearing surface 306 can be disposed in second half 304. A second groove or bearing surface 309 can be disposed in first half 302. A second groove or bearing surface 308 can be disposed in second half 304. Fastening holes 320 can be provided in the two halves 302 and 304 to secure the two halves together. A bag hook 322 can be disposed on the two halves 302 and 304. First half 302 can include an inner surface 328 to be placed adjacent to strip 134 of FIG. 1. Second half 304 can include an inner surface 330 to be placed adjacent to strip 134 of FIG. 1. The two halves 302 and 304 can include outer surfaces 326 and 324 respectively, to receive a clamp (not shown). In some embodiments, the clamp can be clamp 200 of FIG. 2. The two halves 302 and 304 and resulting outer conduit 300 formed thereby can be shaped as a dog-leg. First half 302 can include a tongue 316 running along its length. Second half 304 can include a groove 314 running along its length. Groove 314 can complement tongue 316. A compression or rope gasket 318 can be disposed in groove 314.

Figure 4A:
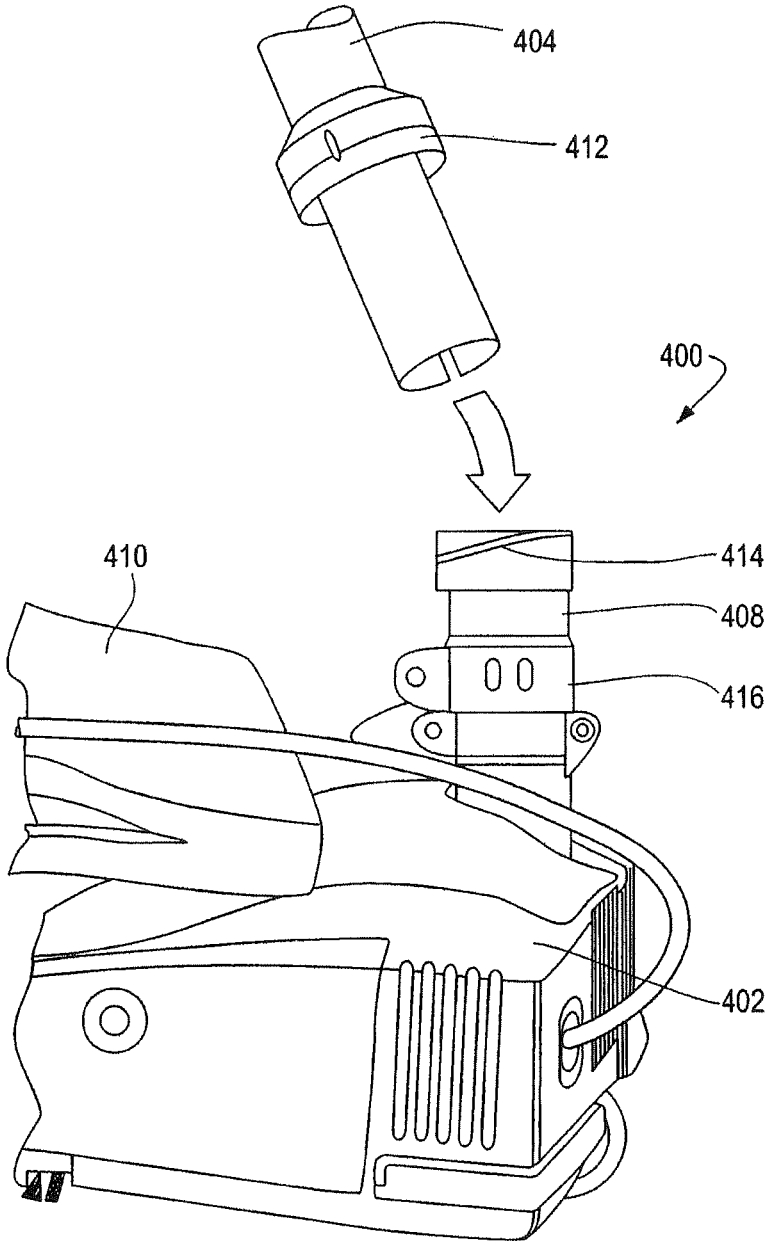
FIG. 4A illustrates one embodiment of a handle being attached to a coupling.

An upright vacuum cleaner 400 is illustrated in FIG. 4A. A motor (not shown) and a beater bar (not shown) can be housed within base 402. A handle 404 can be attached to coupling 404 using a locknut 412. A bag assembly 410 can be disposed on handle 404. Bag assembly 410 can include an outer bag or a housing that includes a disposable bag. Bag assembly 410 can include an outer bag or housing, and an inner disposable bag. When energized, the motor causes air to be drawn from beneath base 402 into a volute. The air flow then passes into coupling 408 and up into handle. Air flow passes through handle 404 ending in bag assembly 410. Locknut 412 can twist on to the lock threads 414 disposed on coupling 404.

The elements and connections have been described above. We now describe one possible operation and working cooperation of those elements that create a vacuum with improved steering.

Figure 4B:
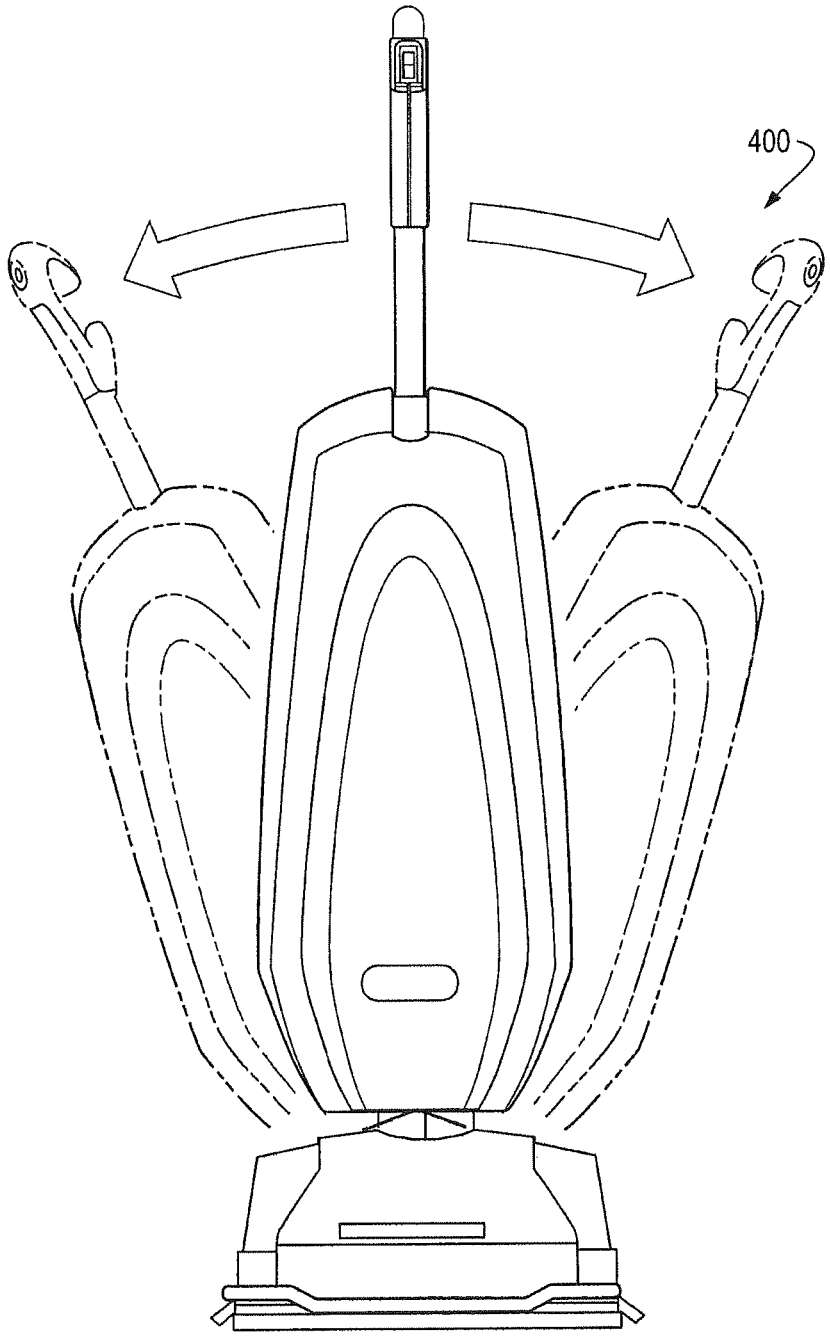
FIG. 4B illustrates one embodiment of a "dirty air" model upright vacuum cleaner.

The operator first pivots the vacuum cleaner so that handle 404 is declined away from its upright position shown in FIG. 4B. The vacuum cleaner 400 is pushed forward during operation over the surface to be cleaned. To maneuver the vacuum to the right the operator need only "twist" handle 404 to the right. This action causes handle 404 and base 402 to rotate in a clockwise direction substantially along their shared longitudinal axis. The clockwise rotation force exerted along handle 404 and base 402 the shared longitudinal axis is translated down to the coupling 408 and applied to volute 136 shown in FIG. 1. Application of rotational or twisting force to handle 404 causes handle 404 to rotate relative to base 402 through coupling 408. Despite this relative rotation, there generally is a twisting or turning force transmitted from handle 404 to base 402 across coupling 408, which force urges base 402 and its nozzle in the corresponding direction of the turn, thus "steering" the vacuum. The friction or interference fit of the rotating conduits of coupling 408 thus allows for rotational force to be transmitted from handle 404 to base 402, while the rotation eases maneuverability of base 402.

It is theorized that coupling 408 provides a break point for a shared longitudinal axis of the handle and body. The clockwise force along handle 404 and base 402 axis "breaks" the shared axis, thereby providing rotation between handle 404 and base 402. Since coupling 408 transfers the twisting force to volute 136 and onto base 402, the base 402 veers to the right. Similarly, a counter-clockwise "twist" of handle 404 will cause nozzle base 402 to veer left. The combination of continued forward pushing of the vacuum while twisting the handle results in nozzle base 402 turning left or right depending on the direction of the handle twist. The effect is an upright style vacuum cleaner with significantly improved maneuverability.

In some embodiments, the compressible strip can comprise any of a variety of felt or felt-like or resiliently compressible materials. Felt can comprise material made of matted fibers of synthetics, wool, or wool and fur, fulled or wrought into a compact substance by rolling and pressure, with lees or size, without spinning or weaving. Felt can also comprise materials whose texture has been changed so as to become matted and felt-like. In some embodiments, the felt can be moistening with a non-reactive lubricant. Moistening of the felt or compressible material can prevent the strip from getting crimped or rolled.

In some embodiments, the strip can completely encircle the inner conduit. The ends of the encircling strip can abut one another around with a minimum of clearance between the two. In some embodiments, the strip can be ¾ of an inch wide. In some embodiments, the strip can be 0.5 inches, 0.75 inches, 1 inch, 1.5 inches, 1.75 inches, or more wide.

The outer conduit can fit snugly around the inner conduit. For example, a clearance between the outer diameter of the inner tube and the inner diameter of the outer tubing can be about 0.003 inches or less. In some embodiments, a clearance between the outer diameter of the compressible strip disposed around the inner tube and the inner diameter of the outer tubing can be about 0.003 inches or less. Similarly, clearance tolerances of about 0.003 inches or less can be used between the bearings and bearing surfaces of a rotational coupling. The tight clearances prevent dust from entering between the bearing surfaces and the bearing, and the compressible strip and its bearing surface in the rotational coupling.

In some embodiments, the clamp can comprise a semi-pliable material. For example, the clamp can comprise a nylon material that is semi-pliable.

In some embodiments, a rotatable coupling can be assembled. For example, the volute and the inner conduit can be molded as a single piece, e.g., from plastic. The volute can be disposed around a motor in the base with the inner conduit extending out from the base. A compressible strip can be placed on the inner conduit.

Detents on the inner conduit can be lubricated using a non-reactive lubricant, such as, Teflon. The non-reactive lubricant can be a high-viscosity lubricant. In some embodiments, the lubricant can provide constant lubrication properties and viscosity over a wide temperature range. In some embodiments, the lubricant can comprise Teflon. In some embodiments, Magna lube G from Sauder Industries of Long Island, N.Y. can be used. Two complementary halves can be fastened in place around the inner conduit. The halves together form the outer conduit. A clamp than can be placed over the lower half of the outer conduit and fastened in place. Lastly, the handle can be fastened to the outer conduit using a lock nut.

The various embodiments described above are provided by way of illustration only and should not be constructed to limit the invention. Those skilled in the art will readily recognize the various modifications and changes which may be made to the present invention without strictly following the exemplary embodiments illustrated and described herein, and without departing from the true spirit and scope of the present invention, which is set forth in the following claims.

What is claimed is:

1. A vacuum cleaner comprising:

a base;

a handle including a conduit; and a rotatable coupling pivotally attached between the base and the handle, the rotatable coupling defining an air channel for providing a flow of air from the base to the conduit in the handle, wherein the handle rotates with respect to the base about the rotatable coupling, wherein the rotatable coupling includes an inner conduit having an outer surface;

an outer conduit having an inner surface, the outer conduit adapted to fit over the inner conduit, the outer conduit being rotatable about the inner conduit; and a seal positioned between the outer surface of the inner conduit and the inner surface of the outer conduit.

2. The vacuum cleaner of claim 1, wherein an interference fit is formed between the inner conduit and the outer conduit, wherein the seal includes the interference fit.

3. The vacuum cleaner of claim 1, wherein the seal includes a bearing surface disposed on the outer conduit and a bearing detent complementing the bearing surface disposed on the inner conduit.

4. The vacuum cleaner of claim 1, wherein the seal includes a bearing surface disposed on the inner conduit and a bearing detent complementing the bearing surface disposed on the outer conduit.

5. The vacuum cleaner of claim 1, wherein the inner conduit is pivotally connected to a vacuum base.

6. The vacuum cleaner of claim 1, wherein the outer conduit includes a dog-leg tum.

7. The vacuum cleaner of claim 1, further comprising a volute disposed at a distal end of a conduit selected from either the inner or outer conduit.

8. The vacuum cleaner of claim 7, wherein a longitudinal axis of the conduit traversing through a conduit center does not traverse a center of the volute.

9. The vacuum cleaner of claim 7, wherein the volute is rotatable and allows the conduit to pivot about a volute center.

10. The vacuum cleaner of claim 1, further comprising an air moving unit to generate the airflow and the coupling is disposed on the pressure-side of the air moving unit.

11. The vacuum cleaner of claim 1, wherein the airflow comprises a dirty airflow.

12. The vacuum cleaner of claim 1, wherein the seal includes a non-reactive lubricant disposed on at least one of the inner conduit and the outer conduit.

13. The vacuum cleaner of claim 1, further comprising a clamp to restrain a movement of the inner conduit with the respect to outer conduit along a longitudinal axis of the inner and outer conduits.

14. The vacuum cleaner of claim 1, wherein the inner conduit comprises a first longitudinal portion including a groove along the first longitudinal portion's length, and a second longitudinal portion including a tongue along the second longitudinal portion's length.

15. The vacuum cleaner of claim 14, wherein the seal includes a compression seal disposed in the groove along the first longitudinal portion's length.

16. The vacuum cleaner of claim 1, wherein the seal includes a pair of detents disposed on the outer surface of the inner conduit and a pair of grooves disposed on the inner surface of the outer conduit, and wherein the pair of grooves complements the pair of detents.

17. The vacuum cleaner of claim 16, wherein the seal further includes a non-reactive high-viscosity lubricant disposed on the outer surface of the inner conduit adjacent at least one of the pair of detents.

18. The coupling of claim 17, wherein an interference fit is formed between the inner conduit and the outer conduit.

19. The vacuum cleaner of claim 16, wherein the seal further includes a non-reactive high-viscosity lubricant disposed on the inner surface of the outer conduit adjacent at least one of the pair of grooves.

20. The vacuum cleaner of claim 1, wherein the seal includes a compressible material positioned on at least one of the inner conduit and the outer conduit.

21. The vacuum cleaner of claim 20, wherein the material comprises synthetic felt.

22. The vacuum cleaner of claim 20, further comprising a groove disposed in the outer surface of the inner conduit, which is adapted to receive the compressible material.

23. The vacuum cleaner of claim 20, wherein the compressible material disposed on the outer surface of the inner conduit is a compressible strip encircling the outer surface of the inner conduit.

* * * * *